US010182279B1

(12) United States Patent
Zhou et al.

(10) Patent No.: US 10,182,279 B1
(45) Date of Patent: Jan. 15, 2019

(54) LIGHT BULB SPEAKER WITH ASSISTANT SPEAKERS UTILIZING ECHO CHAMBER FOR SOUND AMPLIFICATION

(71) Applicants: Alexander Zhou, Exton, PA (US); Ashley Tang, Exton, PA (US); Aaron Tang, Exton, PA (US); Ruochuan Tang, Exton, PA (US)

(72) Inventors: Alexander Zhou, Exton, PA (US); Ashley Tang, Exton, PA (US); Aaron Tang, Exton, PA (US); Ruochuan Tang, Exton, PA (US)

( * ) Notice: Subject to any disclaimer, the term of this patent is extended or adjusted under 35 U.S.C. 154(b) by 0 days.

(21) Appl. No.: 15/822,111

(22) Filed: Nov. 24, 2017

(51) Int. Cl.

| | |
|---|---|
| ***F21V 33/00*** | (2006.01) |
| ***H04R 1/02*** | (2006.01) |
| ***G10K 15/00*** | (2006.01) |
| ***H04R 1/24*** | (2006.01) |

(52) U.S. Cl.
CPC ..... *H04R 1/028* (2013.01); *F21V 33/0056* (2013.01); *G10K 15/00* (2013.01); *H04R 1/24* (2013.01)

(58) Field of Classification Search
CPC ..... F21V 33/0056; H04R 1/028
USPC ..... 381/333, 388; 362/86, 234
See application file for complete search history.

(56) References Cited

U.S. PATENT DOCUMENTS

| | | | | |
|---|---|---|---|---|
| 8,847,491 | B2 * | 9/2014 | Yotsumoto | F21V 33/0056 315/149 |
| 2002/0011379 | A1 * | 1/2002 | Taylor | H04R 1/345 181/155 |
| 2009/0207607 | A1 * | 8/2009 | Haase | F21V 33/0056 362/234 |
| 2011/0317861 | A1 * | 12/2011 | Haase | F21V 33/0056 381/333 |
| 2013/0114826 | A1 * | 5/2013 | Chang | H04R 1/028 381/77 |

* cited by examiner

*Primary Examiner* — Disler Paul

(57) ABSTRACT

The present disclosure provides a light bulb speaker system. The light bulb speaker system includes a housing having an open end and a partially closed end. A coaxial main speaker is positioned proximal to the open end, a first assistant speaker and a second assistant speaker are positioned between the open end and the partially closed end within the housing. The first and second assistant speakers are mounted so that they face perpendicular to a central axis of the light bulb speaker. The system also includes a light source component mounted within an annular frame, the light source proximally mounted within the housing towards the open end. The housing includes a plurality of speaker holes positioned on opposing sides so that the first and the second assistant speaker are configured to align with the plurality of the speaker holes.

13 Claims, 3 Drawing Sheets

LIGHT BULB SPEAKER WITH ASSISTANT SPEAKERS UTILIZING ECHO CHAMBER FOR SOUND AMPLIFICATION

FIELD OF THE INVENTION

The present disclosure relates to recessed lighting and audio fixtures. In particular, the present disclosure provides an enhanced lighting and sound system.

BACKGROUND OF THE INVENTION

Currently, most smart light speakers include a single speaker and an integrated light source. However, the light speaker systems currently known have defects in that the sound is often blurred or muffled creating a non-optimal listening experience for a user. More specifically, present systems produce sounds that not loud enough due to their limited size and internal structure positioning. Thus, there is a need to for a system that provides sound that is amplified and enriched and configured to be adapted within the same housing as a light source and adaptable with existing light fixtures.

SUMMARY OF THE INVENTION

Various embodiments of the invention pertain to recessed lighting and audio fixtures. More particularly, the present disclosure provides a light/sound system with one or multiple assistant speakers in addition to a regular light bulb speaker used in recessed light fixtures, or dome shaped floor light fixtures, or dome shaped pendant light fixtures, so that the sound can be amplified by utilizing the gap between lateral surface of light bulb housing and the internal surface of light fixture housing as an echo chamber.

In an exemplary embodiment, a smart light bulb speaker includes a coaxial main speaker and one or multiple assistant speakers positioned sideways facing the light bulb housing, the assistant speaker in combination with the main speaker provides a louder and enriched audio sound.

DETAILED DESCRIPTION OF THE DRAWINGS

In the following description, numerous specific details are put forth in order to provide a thorough understanding of the invention. However, one skilled in the art would recognize that the invention may be practiced without these specific details. In other instances, well know methods, procedures, and/or components have not been described in detail so as not to unnecessarily obscure aspects of the invention.

The following description, certain terminology is used to describe certain features of one or more embodiments of the invention. The term "speaker" refers to any type of sound-generating devices. The term "light" refers to any type of light generating devices, including a fluorescent light, LED light, Fiber Optic light source, etc. The term "assistant speaker" refers to any type of sound-generation devices of any size, it could be bigger or smaller or equal size as main speaker. The term "dome shape light housing" refers to light housing of any size, any shape that can hold the light bulb speaker as long as the open end is wider than the closed end.

The following description, the light speaker system is not only limited with light bulb with speaker function, but also applies to light bulb speakers with other integrated functions, like video camera, microphone and sensors, etc.

Figure 1:
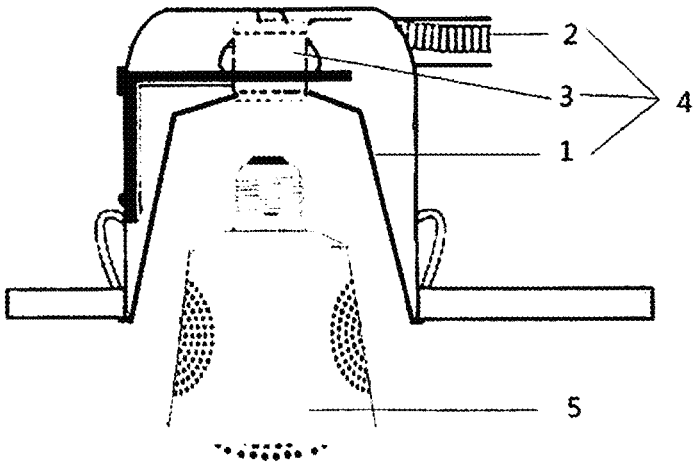
FIG. 1 illustrates a smart light speaker and a ceiling-mount recessed light housing according to an exemplary embodiment of the present invention.

FIG. 1 illustrates a ceiling light bulb housing assembly 4 and a stand-alone smart light speaker 5. The ceiling light bulb housing assembly includes a metal housing 1, electric wiring and wiring wrapper 2, a light bulb base holder 3, which may be configured to receive various light bulb bases and connectors. The ceiling-mount recessed light housing 4 is typically installed on top of ceiling of a room or building, and wired together with wall switch. The smart light speaker 5 is made to lit into the ceiling mount recessed light housing unit and mounted to the base holder.

Figure 2:
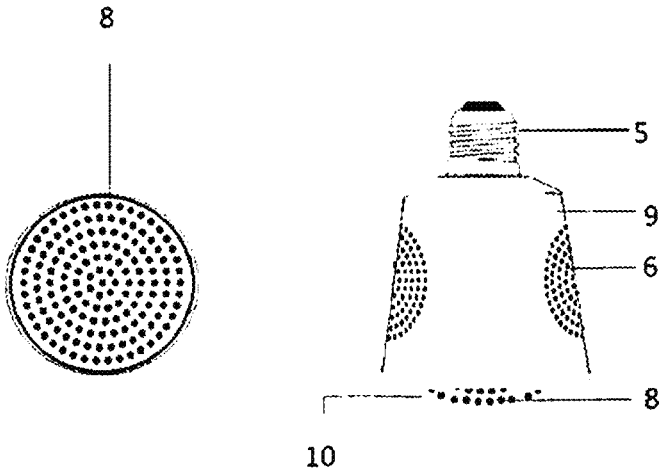
FIG. 2 illustrates a bottom and side view of a smart light speaker of FIG. 1 with assistant speaker(s).

FIG. 2 illustrates a bottom view and side view of a smart light speaker with assistant speaker(s). In one embodiment, there is a first assistant speaker and a second speaker mounted inside and positioned between the open end and partially closed end of the light housing. The first assistant speaker is positioned perpendicular to the vertical axis and the second assistant speaker is positioned perpendicular to the vertical axis and on the opposite side of the first assistant speaker. In another embodiment, the first and second assistant speakers may be positioned so that the speakers can be angled between 0 degrees and 180 degrees from the vertical axis. The smart light bulb speaker includes a light bulb base 5, the light bulb housing 9, the bottom cap 10, the main speaker holes 8, assistant speaker holes 6.

Figure 3:
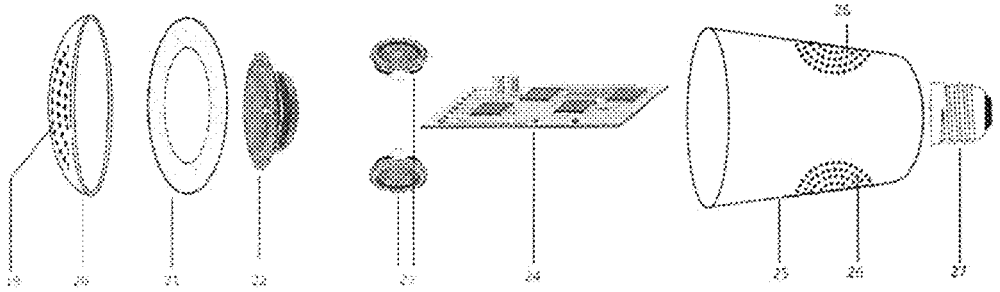
FIG. 3 illustrates a detailed assembly view of a new smart light speaker with assistant speaker(s) according to the exemplary embodiment of the invention.

FIG. 3 also illustrates the internal assembly view of a smart light speaker with assistant speakers. The assembly includes a bottom cap 20 which has main speaker holes 19 for sound generated by main speaker to pass through, a light source 21 that is centrally mounted, which could be any form of light-generation device, a main speaker 22 facing the bottom cap side, two assistant speakers 23 facing outside towards light housing and aligned with speaker holes positioned on the surface of the housing, a circuit board 24, which will be used for power regulation, switch control, wireless communication for remoted light source control, remote speaker control and wireless audio streaming. A light speaker housing 25, which has an open end and a partially closed end, will be used as the housing component to contain the disclosed components. The main speaker and light source will be centrally mounted within the open end of the housing and the light bulb base 27 will be mounted on the partially closed end for electrical connection and holding the light bulb speaker inside the recessed light housing or other dome shape light housing. Towards a central portion of the light housing, there are speaker holes 26 aligned with the assistant speakers inside the light housing. The speaker holes are positioned so that the area holes or apertures is greater than the assistant speaker body portion. In one embodiment, the assistant speakers may be mounted on a shelf or internal frame structure. In another embodiment, the assistant speakers may be position on a track on opposition portions of the housing and be moveable on the track. In another embodiment, the assistant speakers may be configured to move independently from one another within the housing. In an exemplary embodiment, the assistant speakers may be positioned to be perpendicular to the vertical axis.

Figure 4:
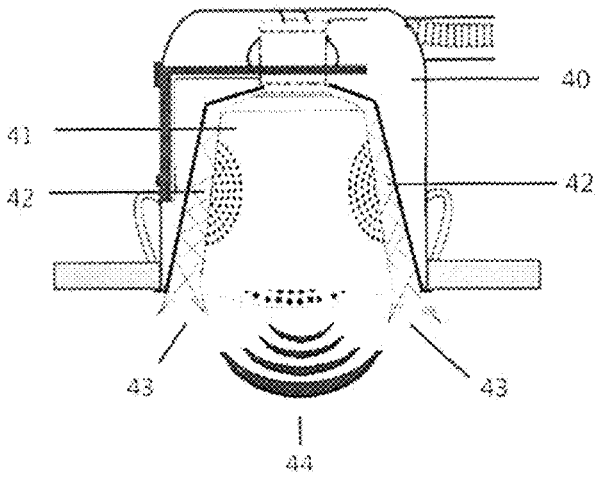
FIG. 4 illustrates a path of a sound wave according to one embodiment of the invention.

FIG. 4 illustrates how the smart light speaker system with assistant speaker is operated. A recessed light housing assembly 40 is generally ceiling-mounted. However, in other embodiments, the light housing assembly may be mounted any wall. The smart light speaker system 41 is mounted inside the light housing assembly as illustrated. When the smart light speaker is powered on by the control unit, either remotely or with a wired control unit, the light source will be turned on or stay off based on user setting. When the user switches on the audio function, audio content is transferred from an audio source to the smart light speaker, through wireless audio streaming or by wired audio streaming. The main speaker inside the smart light speaker system will being generating sound waves 44 and the sound waves 44 will pass through speaker holes located on the bottom cap of the light speaker system. Simultaneously, the assistant speakers inside the light housing will generate sound waves which pass through the speaker holes aligned with the first and second assistant speakers and enter echo chamber 42. The echo chamber 42 is formed by the lateral surface of the light speaker housing and the internal surface of the recessed light fixture housing. The sound waves generated by the first and second assistant speakers will then be reflected back and forth inside the echo chamber. As a result of the reflection within the echo chamber 42, the sound waves are amplified and enriched by the echo chamber 42 as shown in FIG. 4. The amplified and enriched sound wave 43 will come out of the opening gap between the bottom of the light bulb speaker housing and the lower open end of the recessed light fixture housing. The echo chambers created by the disclosed components allows for the sound waves to have more depth and clarity than the sound waves generated by the main speaker. The sound waves emanating from the assistant speakers also simulate the reverberation of the main speaker and amplify the sound generated from the main speaker.

Figure 5A:
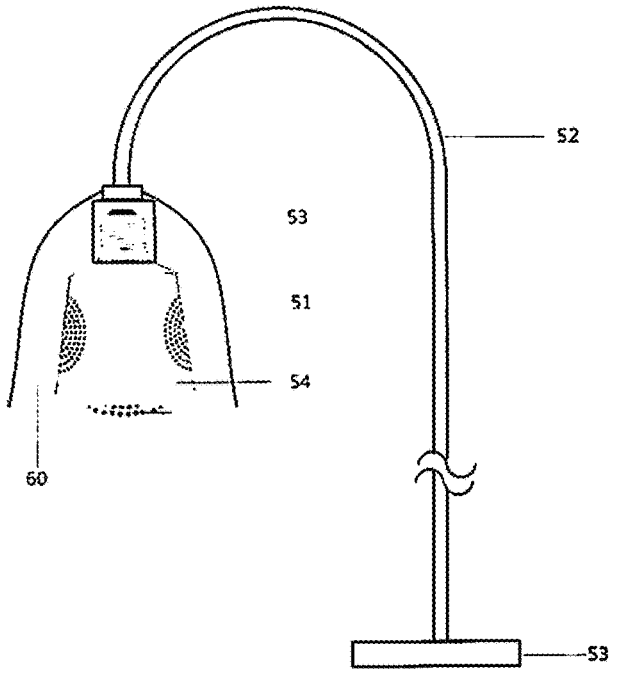
FIG. 5A illustrates another embodiment of a smart light speaker system.
Figure 5B:
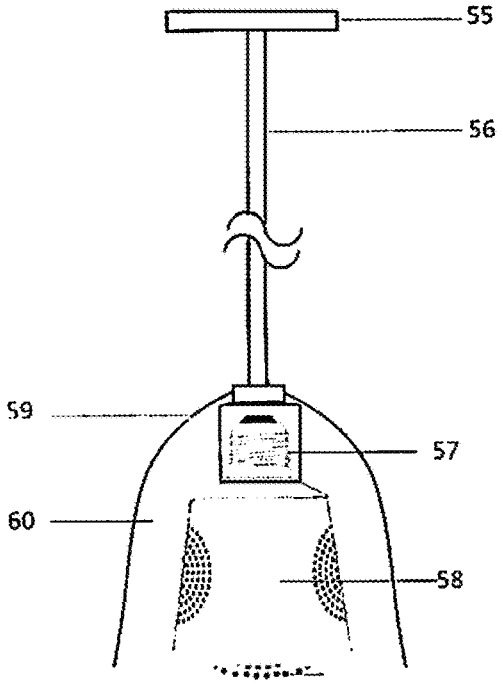
FIG. 5B illustrates yet another embodiment of a smart light speaker system.

FIGS. 5A and 5B illustrate two different embodiments of a smart light speaker system 54 according to the present disclosure. FIG. 5A illustrates a smart light speaker that can be mounted inside a dome shaped floor light fixture 51. The dome shaped light fixture housing is connected with the light fixture support rod 52, which has electrical wires in it. The light fixture support rod is secured on a floor base 53. The sound waves from the assistant speakers will be reflected inside the echo chamber 60 of the dome shaped light fixture and get amplified. FIG. 5B illustrates yet another embodiment of the smart light speaker system. The pendant light fixture 59 includes a smart bulb speaker 58 is mounted inside a dome shape pendant light fixture 59. The light speaker base 57 is securely fixed inside the light fixture for electricity connection. The ceiling mount 55 and pendant light fixture rod 56 will be connected with the dome shape pendant light fixture 59. The gap between the dome shape pendant light fixture 59 and light bulb speaker 58 forms an echo chamber 60 for sound wave coming out of the assistant speakers to be amplified.

In other embodiments, it should be noted that the echo chamber created in the gap between the speaker and the light fixture may be designed to be larger or smaller based on the lighting fixtures.

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

Having described certain implementations of the light bulb speaker system and methods of their use, it will now become apparent to one of skill in the art that other implementations incorporating the concepts of the disclosure may be used. Therefore, the disclosure should not be limited to certain implementations, but rather should be limited only by the spirit and scope of the following claims.

We claim:

1. A light bulb speaker system comprising:

a housing having an open end and a partially closed end;

a coaxial main speaker positioned proximal to the open end;

a first assistant speaker and a second assistant speaker positioned between the open end and the partially closed end within the housing; and mounted outward perpendicular to a central axis of the light bulb speaker system;

a light source component mounted within an annular frame, the light source proximally mounted within the housing towards the open end;

wherein the housing includes a plurality of speaker holes positioned on opposing sides so that the first and the second assistant speaker are configured to align with the plurality of the speaker holes wherein the main speaker generates sound waves and pass through a bottom cap of the speaker system and simultaneously the first assistant speaker and the second assistant speaker produce sound waves, the sound waves of the first and second assistant speakers pass through the speaker holes on the opposing sides of the light housing, get reflected back and forth between the inner surface of a recess light housing and the lateral surface of the light housing in an echo chamber thereby amplifying the sound waves and continue downward mixing with the sound waves of the main speaker thereby simulate the reverberation and amplifying sound generated by the main speaker, wherein the first assistant speaker and the second assistant speaker are configured to be moved independently of one another.

2. The light bulb speaker system of claim 1, wherein the plurality of speaker holes are configured in concentric circles on opposing lateral sides of the housing.

3. The light bulb speaker system of claim 1, wherein the partially close end of the housing includes a light bulb connector configured to couple to an electrical source.

4. The light bulb speaker system of claim 1, wherein the plurality of speaker holes extends circumferentially around the housing.

5. The light bulb speaker system of claim 1, wherein when the first assistant speaker and the second assistant speaker produce sound waves, the sound waves pass through the speaker holes, and get reflected back and forth between the inner surface of a dome shape floor light housing and the lateral surface of light bulb housing thereby amplifying the sound waves.

6. The light bulb speaker of system 1, wherein when the first assistant speaker and the second assistant speaker produce sound waves, the sound waves pass through the speaker holes, and get reflected back and forth between the inner surface a dome shaped pendant light housing and the lateral surface of light bulb housing, thereby amplifying the sound waves.

7. A light bulb speaker system comprising:

a housing having an open end and a partially closed end;

a coaxial main speaker positioned proximal to the open end;

at least a first speaker positioned between the open end and the partially closed end within the housing; and mounted perpendicular to a central axis of the main speaker;

a light source component mounted within an annular frame, the light source proximally mounted within the housing towards the open end wherein the housing includes a plurality of speaker holes positioned so that the first speaker is aligned with the plurality of the speaker holes, and the first speaker include a first assistant speaker and a second assistant speaker wherein the main speaker generates sound waves and pass through a bottom cap of the speaker system and simultaneously the first assistant speaker and the second assistant speaker produce sound waves, the sound waves of the first and second assistant speakers pass through the speaker holes on the opposing sides of the light housing, get reflected back and forth between the inner surface of a recess light housing and the lateral surface of the light housing in an echo chamber thereby amplifying the sound waves and continue downward mixing with the sound waves of the main speaker thereby simulate the reverberation and amplifying sound generated by the main speaker, wherein the first assistant speaker and the second assistant speaker are configured to be moved independently of one another.

8. The light bulb speaker system of claim 7, wherein the first speaker and the second speaker are positioned on a longitudinal axis perpendicular to the central axis of the light bulb speaker system.

9. The light bulb speaker system of claim 8, wherein the plurality of speaker holes are position opposing sides of the housing and aligned with the first speaker and the second speaker.

10. The light bulb speaker system of claim 8, wherein the plurality of speaker holes are configured in concentric circles on opposing lateral sides of the housing.

11. The light bulb speaker system of claim 8, wherein the plurality of speaker holes extends circumferentially around the housing.

12. The light bulb speaker system of claim 7, wherein the partially close end of the housing includes a light bulb connector configured to couple to an electrical source.

13. The light bulb speaker system of claim 7, wherein the first speaker and the second speaker produce sound waves configured to pass through the speaker holes and contacting the inner surface of the recessed light housing and reflected back and contacting the outer surface of the housing and repeatedly contacting the inner surface of the recessed housing the outer surface of speaker housing, thereby amplifying the sound waves as they travel towards the open end of the speaker housing.

* * * * *